US008696527B2

(12) United States Patent
Wu

(10) Patent No.: US 8,696,527 B2
(45) Date of Patent: Apr. 15, 2014

(54) EXERCISER WITH EASY-TO-ADJUST INELASTIC STRAPS

(76) Inventor: Ying-Ching Wu, Tainan (TW)

( * ) Notice: Subject to any disclaimer, the term of this patent is extended or adjusted under 35 U.S.C. 154(b) by 333 days.

(21) Appl. No.: 13/346,806

(22) Filed: Jan. 10, 2012

(65) Prior Publication Data

US 2013/0178345 A1 Jul. 11, 2013

(51) Int. Cl.

| | |
|---|---|
| ***A63B 21/002*** | (2006.01) |
| ***A63B 21/068*** | (2006.01) |
| ***A63B 21/00*** | (2006.01) |

(52) U.S. Cl.

USPC ..... 482/95; 482/91; 482/131

(58) Field of Classification Search

USPC ..... 482/40, 43, 91, 95, 96, 126, 129, 131, 482/139, 143, 904

See application file for complete search history.

(56) References Cited

U.S. PATENT DOCUMENTS

| | | | | |
|---|---|---|---|---|
| 6,361,478 | B1 * | 3/2002 | Giancaspro | 482/69 |
| 7,044,896 | B2 | 5/2006 | Hetrick | 482/95 |
| 7,090,622 | B2 | 8/2006 | Hetrick | 482/92 |
| 7,651,448 | B2 * | 1/2010 | Hetrick | 482/95 |
| 7,652,953 | B1 * | 1/2010 | Fluegge | 368/10 |
| 7,955,236 | B2 * | 6/2011 | DiGiovanni et al. | 482/124 |
| 8,007,413 | B1 | 8/2011 | Wu | 482/91 |
| 8,197,392 | B2 * | 6/2012 | Silverman et al. | 482/91 |
| 2005/0085350 | A1 * | 4/2005 | Shen | 482/91 |
| 2007/0027005 | A1 * | 2/2007 | Hetrick | 482/91 |
| 2007/0142185 | A1 * | 6/2007 | Woodman et al. | 482/69 |
| 2007/0173383 | A1 * | 7/2007 | Feigenbaum et al. | 482/91 |
| 2010/0016132 | A1 * | 1/2010 | Flynn | 482/122 |
| 2012/0100968 | A1 * | 4/2012 | Tilton et al. | 482/131 |
| 2012/0270706 | A1 * | 10/2012 | Wu | 482/91 |
| 2012/0329620 | A1 * | 12/2012 | White et al. | 482/131 |
| 2013/0005544 | A1 * | 1/2013 | Butler et al. | 482/139 |
| 2013/0143724 | A1 * | 6/2013 | DeMeo | 482/131 |
| 2013/0217547 | A1 * | 8/2013 | Hinds et al. | 482/96 |

* cited by examiner

*Primary Examiner* — Stephen Crow
(74) *Attorney, Agent, or Firm* — Alan Kamrath; Kamrath IP Lawfirm, P.A.

(57) ABSTRACT

An exerciser includes two straps and a handle mounted to an end of each strap by an adjusting member having a movable rod movable between two positions respectively allowing and not allowing adjustment of the length of the strap. A connecting member is mounted to the other end of each strap. A stop is engaged with an end of an inelastic strap on a suspension member. A retaining ring is engaged with the other end of the inelastic strap. A plurality of rings is fixed to the inelastic strap. The retaining ring is releasably engageable with one of the rings, so that the inelastic strap forms a loop. The connecting member is releasably engaged with one of the rings. The inelastic strap is mounted around a rod or extended through a gap between a door and a door frame, allowing user to perform exercises resisting the weight of the user.

2 Claims, 10 Drawing Sheets

EXERCISER WITH EASY-TO-ADJUST INELASTIC STRAPS

BACKGROUND OF THE INVENTION

The present invention relates to an exerciser and, more particularly, to an exerciser including two inelastic straps that can be easily adjusted in length and two handles allowing the exerciser to exercise the muscles by performing exercises resisting the weight of the user.

A wide variety of exercisers is available on the market for exercising the muscles by resisting the weight. An example of the exercisers of this type is dumbbells. Various exercisers are required for exercising muscles of different parts of the human body. These exercisers are generally expensive and occupy a large space. Some of the exercisers allowing the user to resist the weight of a portion of the components of the exercisers have certain weights and volumes and are, thus, not suitable for use in homes. General users can only use small-size exercisers such as dumbbells.

Thus, a need exists for an exerciser that can be used at home.

BRIEF SUMMARY OF THE INVENTION

The present invention solves this need and other problems in the field of exercisers providing convenient use while allowing easy adjustment in length by providing an exerciser including a connecting member having first and second portions. A linking member includes a first linking portion and two second linking portions. The first linking portion is engaged with the second portion of the connecting member. The exerciser further includes two connecting rings engaged with the second linking portions. The exerciser further includes two straps each having first and second ends and first and second sections between the first and second ends. The first end of each strap is connected to one of the connecting rings. The exerciser further includes two sleeves each wound around the first section of one of the straps. Each sleeve is fixed to the second section of one of the straps. Each sleeve is movable along the first section of one of the straps.

The exerciser further includes two movable rods each including two ends and a shank extending between the ends of the movable rod. The exerciser further includes two frames each having a first portion and a second portion formed on the first portion. The first portion of each frame includes two first beams spaced in a length direction and two second beams extending between the first beams, with the second beams spaced in a width direction perpendicular to the length direction. The second portion of each frame includes two legs respectively extending from the second beams in a height direction perpendicular to the length direction and the width direction. The second portion of each frame further includes a connecting section extending between the legs. Each connecting section includes first and second sides spaced in the length direction. The ends of each movable rod are slideably engaged on the legs of the second portion of one of the frames, with the shank of the movable rod located on the second side of the connecting section.

The second end of each strap is extended from the first side to the second side from below one of the connecting sections and wound around the shank of one of the movable rods and then extended from the second side to the first side from below the connecting section, with the first section of each strap defined between one of the connecting rings and the movable rod, with the second section of each strap defined between the second end of the strap and the movable rod and connected to the first section of the strap, with the second section located between the first section of the strap and the first side of the connecting section, with the first side of the connecting section located between the second side of the connecting section and the second section of the strap, with the second side of the connecting section located between the first side of the connecting section and the shank of one of the movable rods.

The exerciser further includes two connecting straps each including two ends. The ends of each connecting strap are connected to one of the first beams. The exerciser further includes two handles each mounted to one of the connecting straps. The exerciser further includes two suspension belts each mounted to one of the handles. A stop is engaged with a first end of an inelastic strap and has cross sections larger than the inelastic strap. A plurality of rings is fixed to the inelastic strap. A retaining ring is engaged with a second end of the inelastic strap.

The first portion of the connecting member is releasably engageable with one of the plurality of rings. The retaining ring is releasably engageable with one of the plurality of rings, so that the inelastic strap forms a loop.

Each movable rod is movable relative to one of the frames between a first position and a second position. A spacing between the movable rod in the first position and the connecting section in the height direction is smaller than a spacing between the movable rod in the second position and the connecting section in the height direction.

When each movable rod is in the first position, an intersection of the first and second sections of each strap is securely sandwiched between the shank and the connecting section. The lengths of the first and second sections are not adjustable. A spacing between each handle and one of the connecting rings is fixed in the height direction.

When each movable rod is in the second position, the intersection of the first and second sections of each strap is not sandwiched between the shank and the connecting section. The length of the first section and the length of the second section are adjusted if each sleeve is moved relative to the first section, changing a spacing between each handle and one of the connecting rings. The spacing between each handle and one of the connecting rings is decreased if the second end of each strap is moved towards the first end of the strap. The spacing between each handle and one of the connecting rings is increased if the second end of each strap is moved away from the first end of the strap.

In the form shown, each of the ends of each movable rod includes a receiving portion slideably engaged around an outer periphery of one of the legs of the second portion of one of the frames. The shank of each movable rod is tangential to the outer periphery of each receiving portion.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figures 1, 1A:
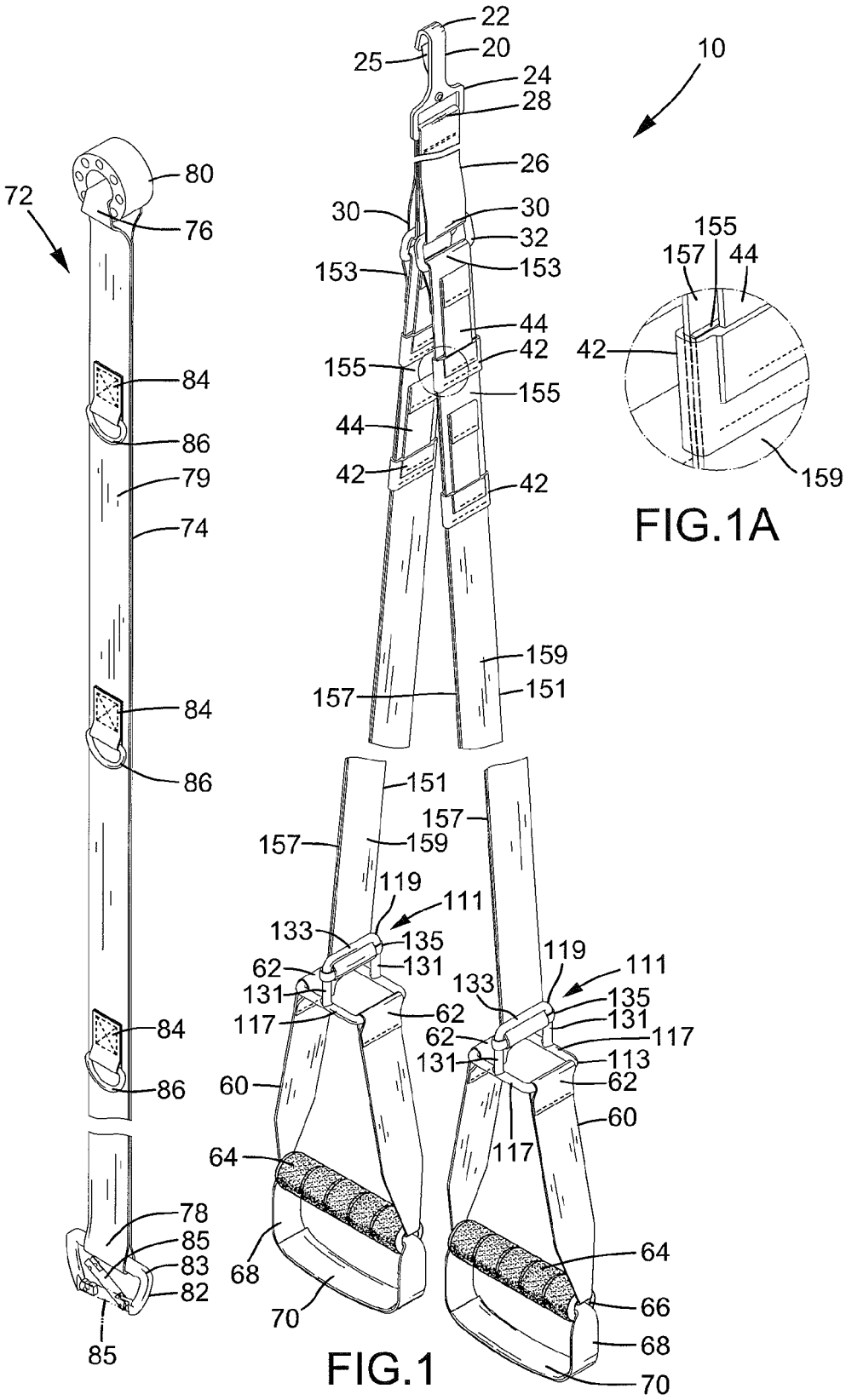
FIG. 1 shows a perspective view of an exerciser according to the present invention.
FIG. 1A shows an enlarged view of a circled portion in FIG. 1.
Figure 1B:
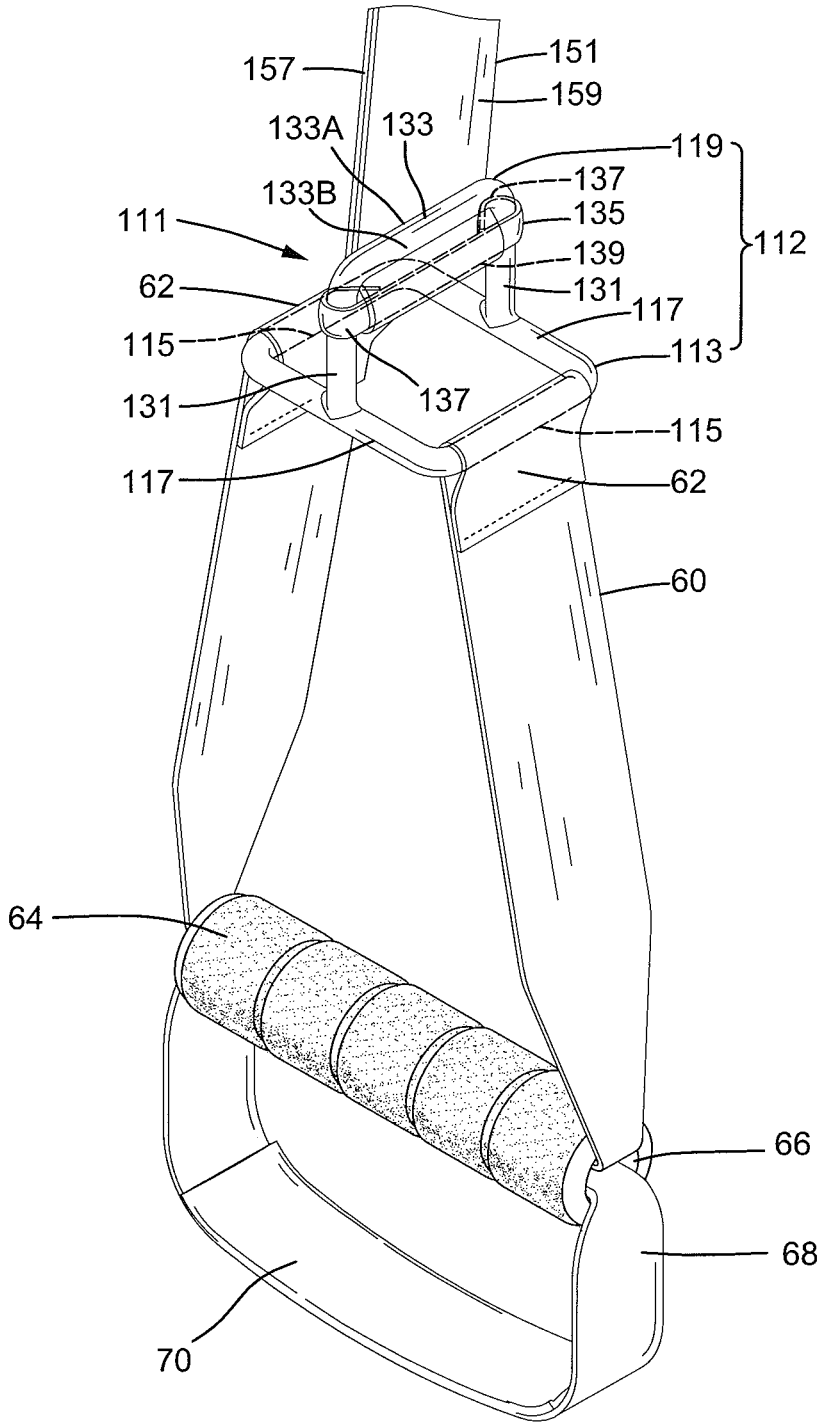
FIG. 1B shows a perspective view of a handle and an adjusting member of the exerciser of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "upper", "outer", "side", "end", "portion", "section", "spacing", "length", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An exerciser according to the present invention is shown in the drawings and generally designated 10. According to the form shown, exerciser 10 includes a connecting member 20 having a hooked, first portion 22 and a looped, second portion 24. Connecting member 20 further includes a resilient plate 25 to releasably close an opening of first portion 22.

Figure 2:
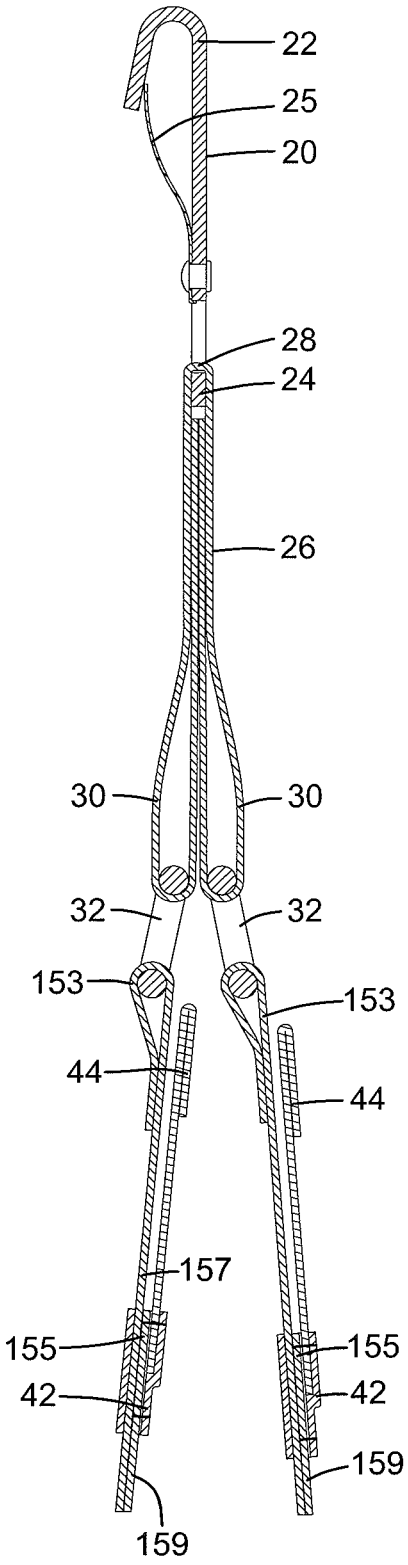
FIG. 2 shows a cross sectional view of a connecting member and portions of two length-adjustable inelastic straps of the exerciser of FIG. 1.

According to the form shown, exerciser 10 further includes a linking member 26 made of inelastic fabric of canvas or nylon. Linking member 26 includes a first linking portion 28 and two second linking portions 30. First linking portion 28 is engaged with second portion 24 of connecting member 20. In the form shown, linking member 26 is a strap wound around second portion 24 of connecting member 20, and two distal ends of the strap are turned upward and sewn together to form second linking portions 30 each in the form of a loop (FIG. 2). A connecting ring 32 is engaged with each second linking portion 30.

According to the form shown, exerciser 10 further includes two length-adjustable straps 151 made of inelastic fabric of canvas or nylon. Each strap 151 includes spaced first and second ends 153 and 155. Each strap 151 further includes first and second 157 and 159 between first and second ends 153 and 155. First end 153 of each strap 151 is connected to one of connecting rings 32.

According to the form shown, exerciser 10 further includes four sleeves 42 made of inelastic fabric of canvas or nylon. Two of sleeves 42 are slideably mounted around first section 157 of one of straps 151 and sewn to second section 159 of the strap 151 (FIG. 2). The other two sleeves 42 are slideably mounted around first section 157 of the other strap 151 and sewn to second section 159 of the other strap 151 (FIG. 2). Thus, each sleeve 42 can be moved to urge second section 159 of one of straps 151 to move along first section 157. A pull tape 44 can be sewn to each sleeve 42 to allow manual pulling for moving sleeve 42 and second section 159 of one of straps 151. It can be appreciated that each strap 151 can include only one sleeve 42 to achieve the length-adjusting function.

According to the form shown, exerciser 10 further includes two adjusting members 111 each having a substantially T-shaped frame 112 and a movable rod 135. Specifically, frame 112 includes an annular first portion 113 and a substantially U-shaped second portion 119 formed on first portion 113. First portion 113 includes two first beams 115 spaced in a length direction and two second beams 117 extending between first beams 115, with second beams 117 spaced from each other in a width direction perpendicular to the length direction. Second portion 119 includes two legs 131 each extending from an intermediate section of one of second beams 117. Second portion 119 further includes a connecting section 133 interconnected between legs 131 and spaced from first portion 113 in a height direction perpendicular to the length direction and the width direction. Connecting section 133 includes first and second sides 133A and 133B spaced in the length direction. Movable rod 135 includes two ends each having a receiving portion 137 having cross sections corresponding to those of one of legs 131. Receiving portions 137 are slideably engaged around legs 131 such that movable rod 135 can slide relative to legs 131 in the height direction. Movable rod 135 further includes a shank 139 extending between the ends of movable rod 135 and tangential to receiving portions 137. Movable rod 135 is movable relative to legs 131 between a first position adjacent to connecting section 133 and a second position adjacent to second beams 117. A spacing between movable rod 135 in the first position and connecting section 133 in the height direction is smaller than a spacing between movable rod 135 in the second position and connecting section 133 in the height direction. Furthermore, shank 139 of movable rod 135 is located on second side 133B of connecting section 133.

Second end 155 of each strap 151 is extended from first side 133A to second side 133B from below connecting section 133 of a corresponding adjusting member 111 and wound around shank 139 of movable rod 135 and then extended from second side 133B to first side 133A from below connecting section 133, with second end 155 facing first end 153 of strap 151. First section 157 of each strap 151 is defined between a corresponding connecting ring 32 and a corresponding movable rod 135. Second section 159 of each strap 151 is defined between second end 155 and a corresponding movable rod 135 and is connected to first section 157 of strap 151, with second section 159 located between first section 157 of strap 151 and first side 133A of a corresponding connecting section 133, with first side 133A of connecting section 133 is located between second side 133B of connecting section 133 and second section 159 of strap 151, and with second side 133B of connecting section 133 located between first side 133A of connecting section 133 and shank 139 of movable rod 135. Thus, each adjusting member 111 is hung between first and second sections 157 and 159 of one of straps 151.

Figure 3:
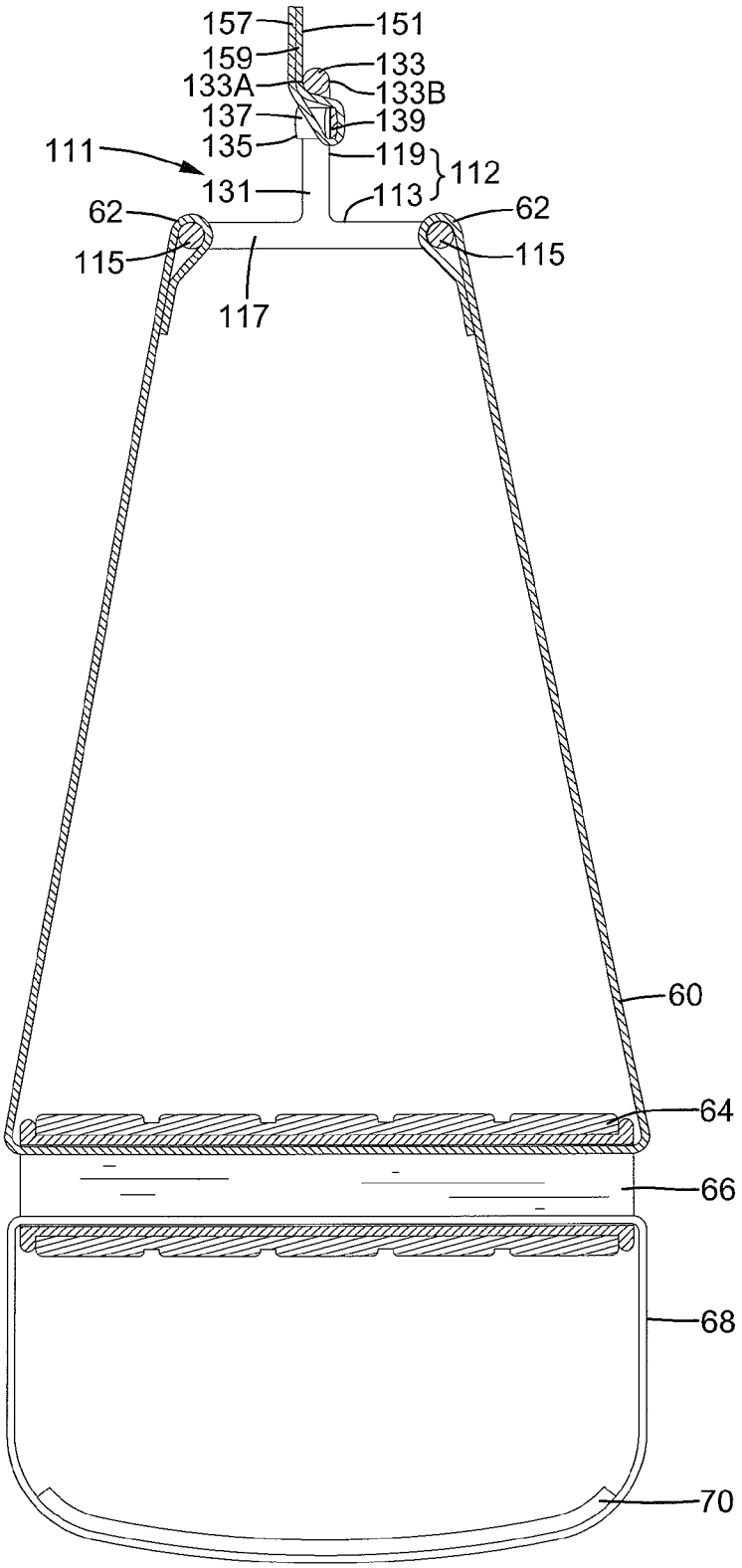
FIG. 3 shows an enlarged, cross sectional view of the handle and the adjusting member of FIG. 1B.

When each movable rod 135 is in the first position (FIG. 3), an intersection between first and second sections 157 and 159 is at a large angle to the height direction and sandwiched between movable rod 135 and the corresponding connecting section 133. In this case, the lengths of first and second sections 157 and 159 are fixed.

Figure 3A:
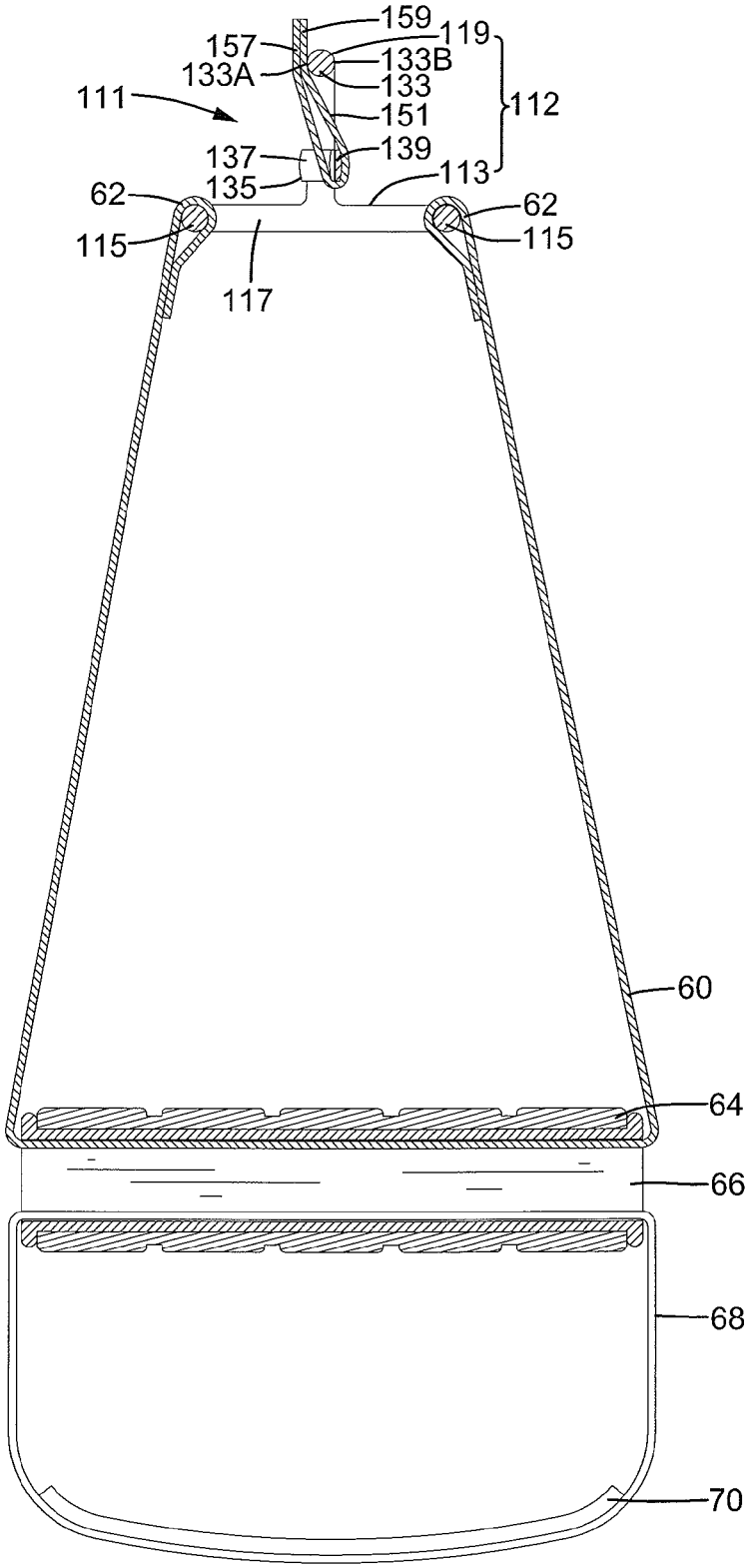
FIG. 3A is a view similar to FIG. 3, wherein a movable rod of the adjusting member is in a position allowing adjustment of the length of the length-adjustable inelastic strap.

On the other hand, when each movable rod 135 is in the second position (FIG. 3A), the intersection between first and second sections 157 and 159 is at a small angle to the height direction and not sandwiched between movable rod 135 and the corresponding connecting section 133. Thus, if second end 155 of each strap 151 is moved along first section 157, the lengths of first and second sections 157 and 159 are changed to adjust a spacing between each adjusting member 111 and a corresponding connecting ring 32.

According to the form shown, exerciser 10 further includes two connecting straps 60 made of inelastic fabric of canvas or nylon. Each connecting strap 60 includes two ends 62 respectively connected to first beams 115 of frame 112 of one of adjusting members 111, so that each connecting strap 60 is hung around one of adjusting members 151. Each connecting strap 60 is extended through a through-hole 66 of a handle 64.

According to the form shown, exerciser 10 further includes two suspension belts 68 made of inelastic fabric of canvas or nylon. A pad 70 formed of foam material is sewn to a face of each suspension belt 68. Each suspension belt 68 is extended through through-hole 66 of one of handles 64, so that pad 70 of suspension belt 68 is opposite to connecting strap 60.

According to the form shown, exerciser 10 further includes a suspension member 72. Suspension member 72 includes a strap 74 made of inelastic fabric of canvas or nylon. Strap 74 includes first and second ends 76 and 78. In the form shown, a stop 80 is mounted to first end 76 of strap 74 and has cross sections larger than strap 74. A retaining ring 82 is mounted to second end 78 of strap 74. Retaining ring 82 includes a substantially C-shaped body 83 and a rod 85 pivotably connected to an end of body 83 and movable between an open position (see solid lines in FIG. 1) revealing an opening of body 83 and a closed position (see phantom lines in FIG. 1) closing the opening of body 83. Three fixing members 84 made of inelastic fabric of canvas or nylon are fixed to a side 79 of strap 74 of suspension member 72 after folding in two, providing a space between two folded portions of fixing member 84. A ring 86 is mounted to each fixing member 84 and extended through the space of fixing member 84.

By adjusting the spacing between the second end 155 of each strap 151 and the corresponding connecting ring 32 in the height direction, the spacing between each frame 112 and the connecting ring 32 can be adjusted in the height direction. Specifically, when each movable rod 135 is in the second position (FIG. 3A), if second end 155 of each strap 151 and sleeves 42 are moved towards the corresponding connecting ring 32, the length of first section 157 of strap 151 is decreased, and the length of second section 159 of strap 151 is increased. Thus, the spacing between each handle 64 and the corresponding connecting ring 32 is reduced.

On the other hand, if second end 155 of each strap 151 and sleeves 42 are moved away from the corresponding connecting ring 32, the length of first section 157 of strap 151 is increased, and the length of second section 159 of strap 151 is decreased. Thus, the spacing between each handle 64 and the corresponding connecting ring 32 is increased.

When each movable rod 135 is in the first position, if each handle 64 is subjected to an external force pulling straps 151, each movable rod 135 is securely retained in the first position by the external force. Thus, the intersection of first and second sections 157 and 159 of each strap 151 is reliably sandwiched between movable rod 135 and the corresponding connecting section 133. As a result, the lengths of first and second sections 157 and 159 of each strap 151 are not changed by the external force during use of exerciser 10.

Figure 4:
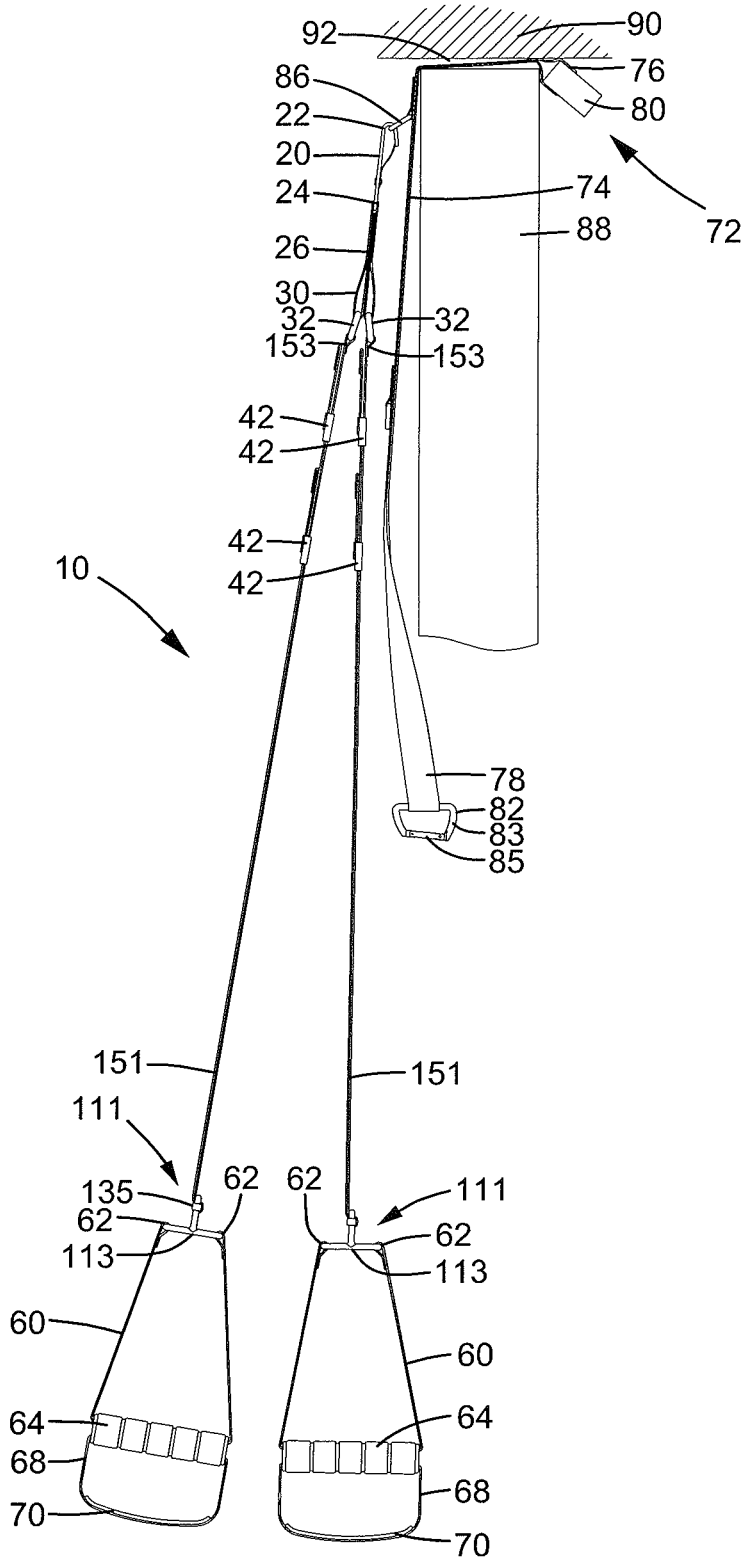
FIG. 4 shows a schematic view illustrating use of the exerciser of FIG. 1 on a door.
Figure 5:
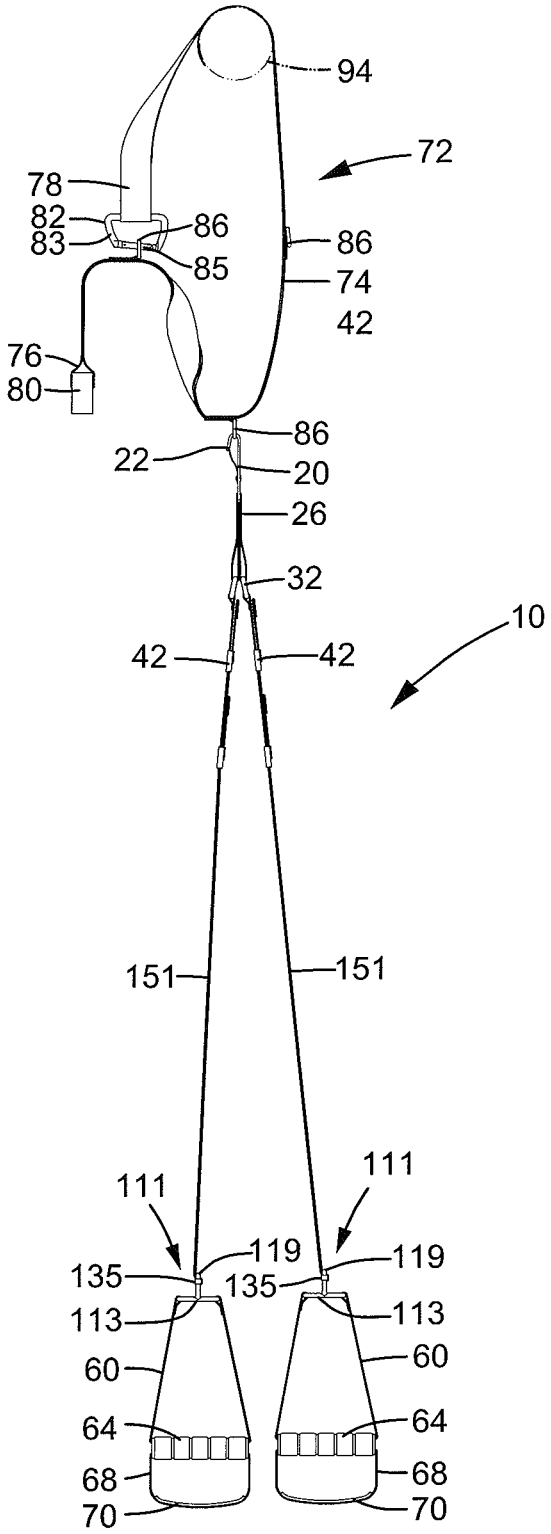
FIG. 5 shows a schematic view of the exerciser of FIG. 1 assembled for use around a rod-like object.

Now that the basic construction of exerciser 10 of the present invention has been explained, the operation and some of the advantages of exerciser 10 can be set forth and appreciated. FIG. 4 shows use of exerciser 10 between two objects. Specifically, strap 74 of suspension member 72 is extended through a gap 92 between a first object 88 (such as a door) and a second object 90 (such as a door frame). Stop 80 is firmly stuck between first and second objects 88 and 90. Disengagement will not occur when strap 74 is subjected to force pulling strap 74 away from stop 80, because stop 80 has a size much larger than gap 92. First portion 22 of connecting member 20 can be engaged with any one of rings 86. This is the first mode of exerciser 10 allowing use in a place without any rod-like supporting structure.

Furthermore, suspension member 72 can be assembled to be in the form of a loop. This is the second mode of exerciser 10 allowing use of exerciser 10 around a rod-like object 94 such as a rail or a trunk of a tree. Specifically, strap 74 is wound around object 94, and retaining ring 82 is then engaged with one of rings 86. First portion 22 of connecting member 20 is engaged with another ring 86.

Figure 7:
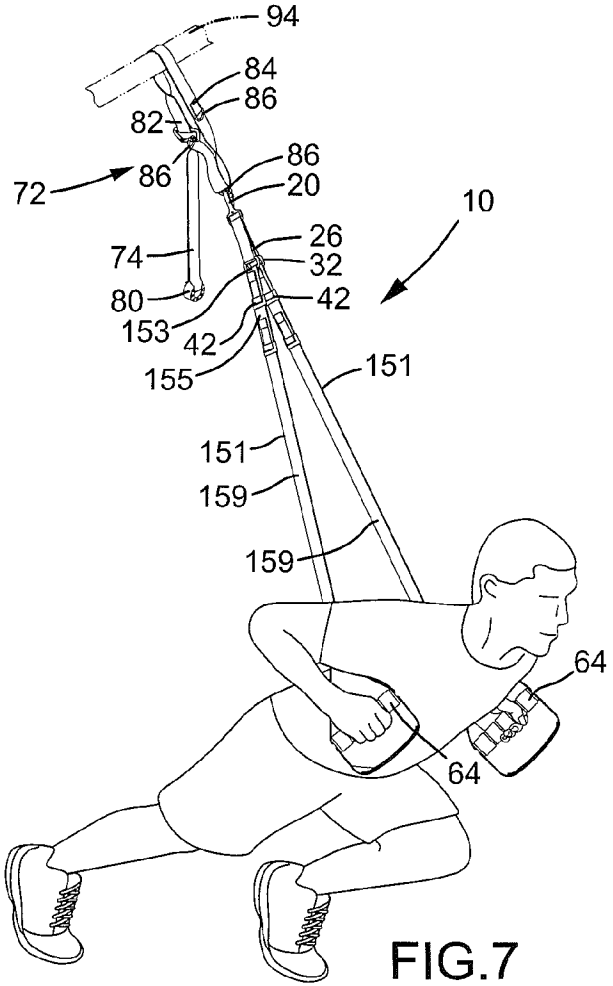
FIGS. 6-11 illustrate poses of a user using the exerciser according to the present invention.
Figure 6:
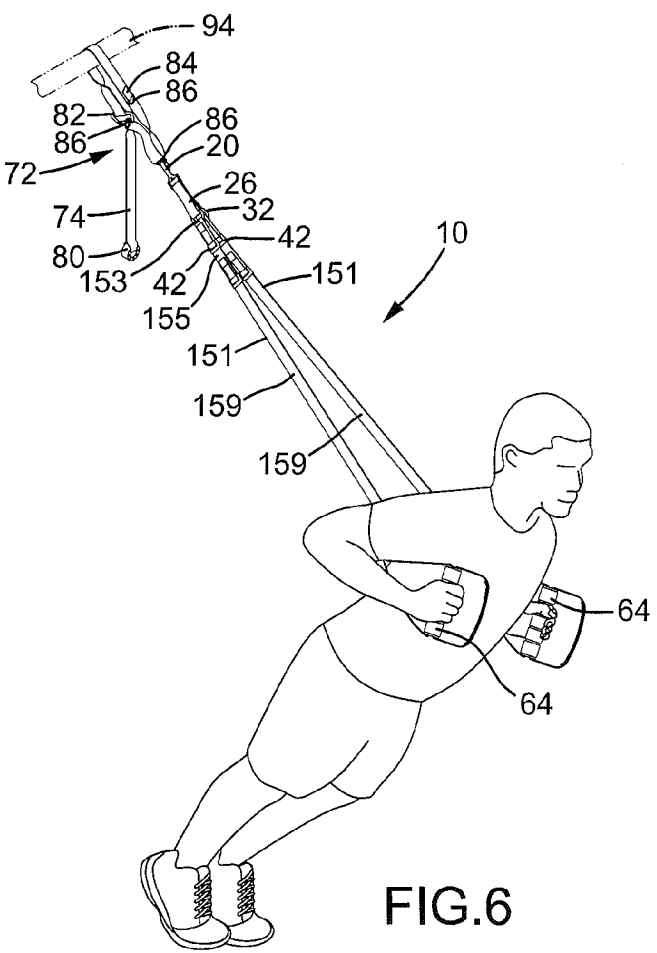

FIGS. 6-11 show examples of use of exerciser 10 in the second mode. With reference to FIG. 6, the user can grip handles 64 with both hands and lean forward with the upper arms at an angle to the forearms and with the wrists close to the sides of the body. The weight of the user is transmitted by exerciser 10 to object 94, maintaining the user in the inclined position. Then, the user can step forward with one of the legs bent in about 90°, as shown in FIG. 7. The user then moves back to the pose shown in FIG. 6 and steps forward with the other leg. The movement can be repeated to exercise the muscles of the arms and the legs.

Figure 9:
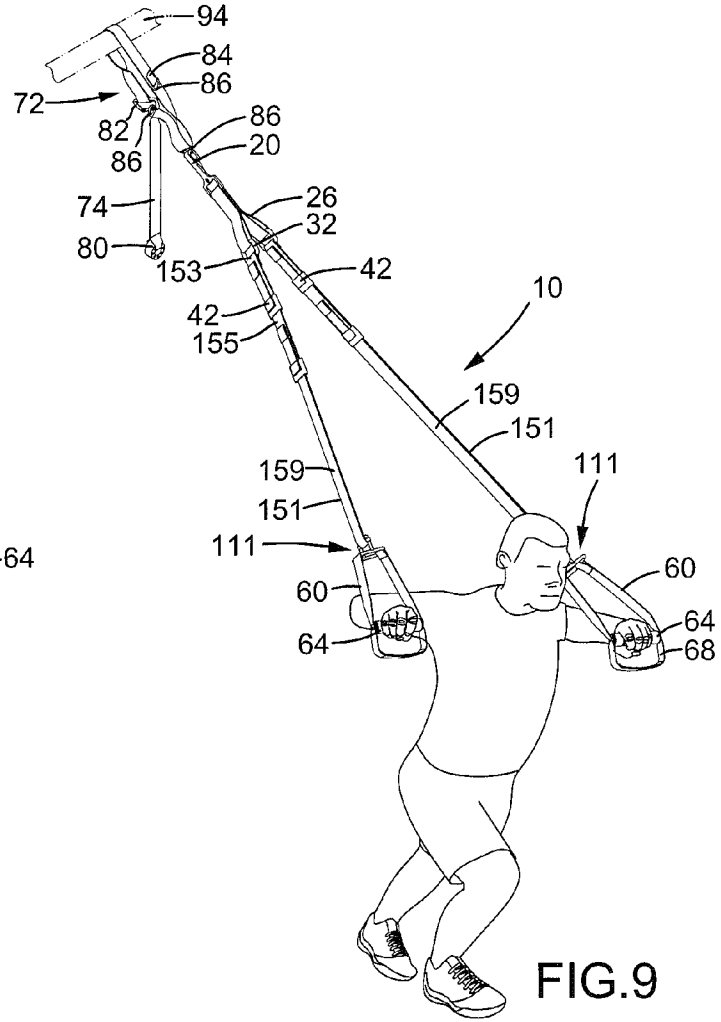
Figure 8:
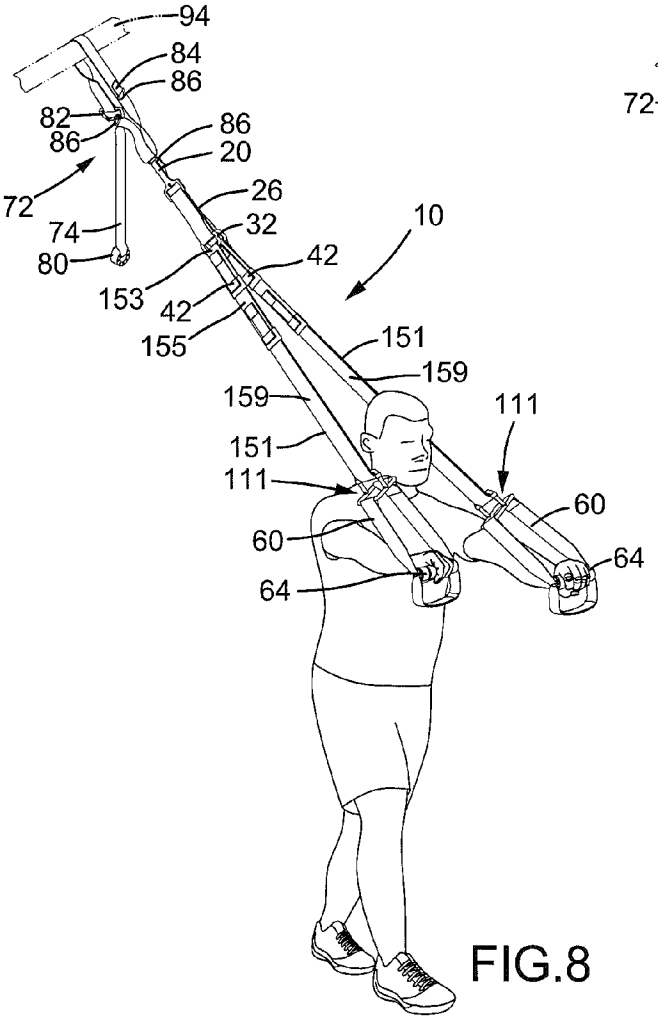

In another example, the user can grip handles 64 with both hands and slightly split the legs in a forward/rearward direction and reach out the arms, as shown in FIG. 8. Then, one of the legs is bent, and the other leg is straight, as shown in FIG. 9. The user then moves back to the pose shown in FIG. 8. The movement can be repeated to exercise the muscles of the upper arms and the forearms.

Figure 11:
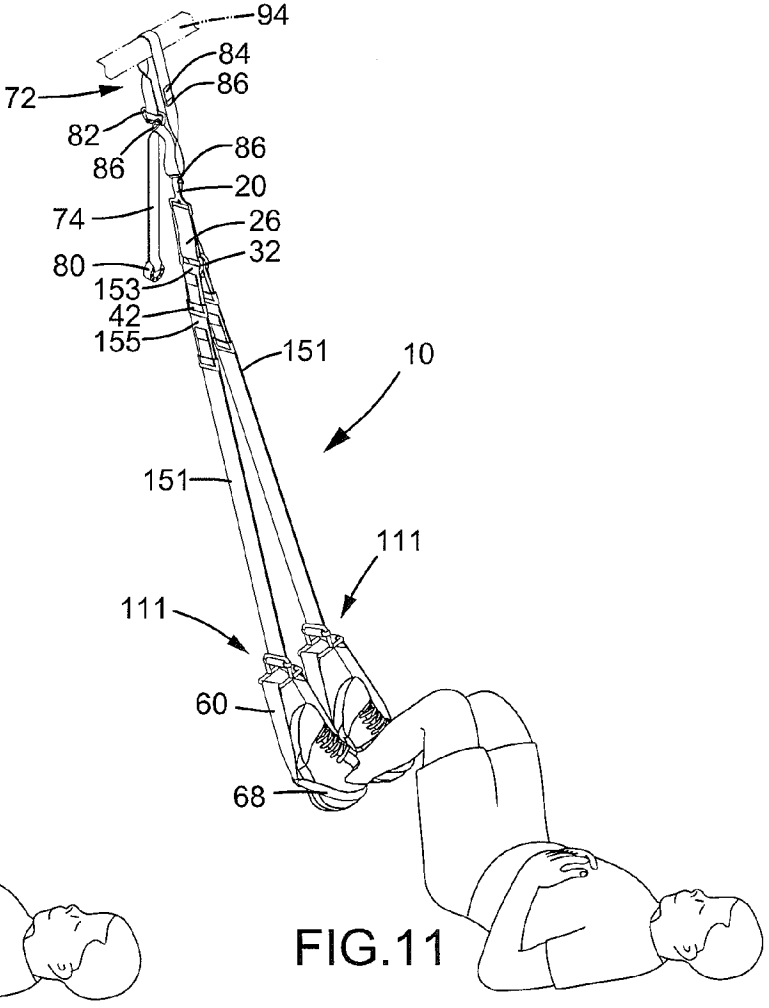
Figure 10:
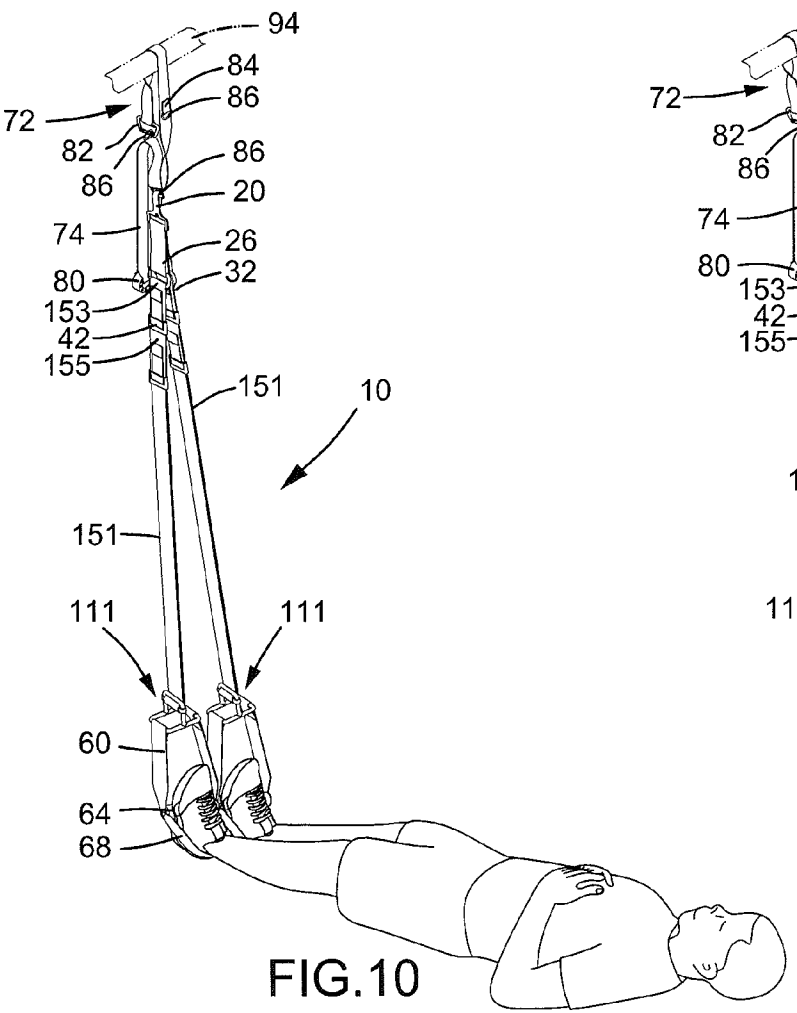

In a further example, the user can lie down on the back and hook handles 64 by the feet with the heels resting on pads 70. The legs are straight, and the arms are on the chest, as shown in FIG. 10. Then, the legs are moved toward the arms until the thighs are at about 90° to the shanks. The buttocks and a portion of the back of the user are moved away from the ground, as shown in FIG. 11. The user then moves back to the pose shown in FIG. 10. The movement can be repeated to exercise the muscles of the abdomen.

Suspension member 72 of exerciser can be detached when not in use. Thus, exerciser 10 according to the present invention can be used in different places to perform different exercises resisting the weight of the user, exercising different muscles of the body. Exerciser 10 according to the present invention is light and small, allowing easy storage and carriage.

Now that the basic teachings of the present invention have been explained, many extensions and variations will be obvious to one having ordinary skill in the art. For example, strap 74 of suspension member 72 does not have to include fixing members 84. Instead, strap 74 can include a plurality of engaging holes for attaching rings 86.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An exerciser comprising, in combination:

a connecting member (20) including first and second portions (22, 24);

a linking member (26) including a first linking portion (28) and two second linking portions (30), with the first linking portion (28) engaged with the second portion (24) of the connecting member (20);

two connecting rings (32) engaged with the two second linking portions (30);

two straps (151) each having first and second ends (153, 155), with each of the two straps (151) including first and second sections (157, 159) between the first and second ends (153, 155), with the first end (153) of each of the two straps (151) connected to one of the two connecting rings (32);

two sleeves (42) each wound around the first section (157) of one of the two straps (151), with each of the two sleeves (42) fixed to the second section (159) of one of the two straps (151), with each of the two sleeves (42) movable along the first section (157) of one of the two straps (151);

two movable rods (135) each including two ends and a shank (139) extending between the two ends of the movable rod (135);

two frames (112) each including a first portion (113) and a second portion (119) formed on the first portion (113), with the first portion (113) of each of the two frames (112) including two first beams (115) spaced in a length direction and two second beams (117) extending between the two first beams (115), with the two second beams (117) spaced in a width direction perpendicular to the length direction, with the second portion (119) of each of the two frames (112) including two legs (131) respectively extending from the two second beams (117) in a height direction perpendicular to the length direction and the width direction, with the second portion (119) of each of the two frames (112) further including a connecting section (133) extending between the two legs (131), with each of the connecting sections (133) including first and second sides (133A, 133B) spaced in the length direction, with the two ends of each of the two movable rods (135) slideably engaged on the two legs (131) of the second portion (119) of one of the two frames (112), with the shank (139) of the movable rod (135) located on the second side (133B) of the connecting section (133), with the second end (155) of each of the two straps (151) extended from the first side (133A) to the second side (133B) from below one of the connecting sections (133) and wound around the shank (139) of one of the two movable rods (135) and then extended from the second side (133B) to the first side (133A) from below the connecting section (133), with the first section (157) of each of the two straps (151) defined between one of the two connecting rings (32) and the movable rod (135), with the second section (159) of each of the two straps (151) defined between the second end (155) of the strap (151) and the movable rod (135) and connected to the first section (157) of the strap (151), with the second section (159) located between the first section (157) of the strap (151) and the first side (133A) of the connecting section (133), with the first side (133A) of the connecting section (133) located between the second side (133B) of the connecting section (133) and the second section (159) of the strap (151), with the second side (133B) of the connecting section (133) located between the first side (133A) of the connecting section (133) and the shank (139) of one of the two movable rods (135);

two connecting straps (60) each including two ends (62), with the two ends (62) of each of the two connecting straps (60) connected to one of the first beams (115);

two handles (64) each mounted to one of the two connecting straps (60);

two suspension belts (68) each mounted to one of the two handles (64);

an inelastic strap (74) including first and second ends (76, 78);

a stop (80) engaged with the first end (76) of the inelastic strap (74) and having cross sections larger than the inelastic strap (74);

a plurality of rings (86) fixed to the inelastic strap (74); and a retaining ring (82) engaged with the second end (78) of the inelastic strap (74), wherein the first portion (22) of the connecting member (20) is releasably engageable with one of the plurality of rings (86), wherein the retaining ring (82) is releasably engageable with one of the plurality of rings (86), so that the inelastic strap (74) forms a loop, wherein each of the two movable rods (135) is movable relative to one of the two frames (112) between a first position and a second position, a spacing between the movable rod (135) in the first position and the connecting section (133) in the height direction is smaller than a spacing between the movable rod (135) in the second position and the connecting section (133) in the height direction, wherein when each of the two movable rods (135) is in the first position, an intersection of the first and second sections (157, 159) of each of the two straps (151) is securely sandwiched between the shank (139) and the connecting section (133), with the lengths of the first and second sections (157, 159) being not adjustable, with a spacing between each of the two handles (64) and one of the two connecting rings (32) fixed in the height direction, wherein when each of the two movable rods (135) is in the second position, the intersection of the first and second sections (157, 159) of each of the two straps (151) is not sandwiched between the shank (139) and the connecting section (133), the length of the first section (157) and the length of the second section (159) are adjusted if each of the two sleeves (42) is moved relative to the first section (157), changing a spacing between each of the two handles (64) and one of the two connecting rings (32), wherein the spacing between each of the two handles (64) and one of the two connecting rings (32) is decreased if the second end (155) of each of the straps (151) is moved towards the first end (153) of the strap (151), and wherein the spacing between each of the two handles (64) and one of the two connecting rings (32) is increased if the second end (155) of each of the straps (151) is moved away from the first end (153) of the strap (151).

2. The exerciser as claimed in claim 1, with each of the two ends of each of the two movable rods (135) including a receiving portion (137) slideably engaged around an outer periphery of one of the legs (131) of the second portion (119) of one of the frames (112), with the shank (139) of each of the movable rods (135) tangential to the outer periphery of each of the receiving portions (137).

* * * * *